US009365058B2

(12) United States Patent
Lo et al.

(10) Patent No.: US 9,365,058 B2
(45) Date of Patent: Jun. 14, 2016

(54) PRINTER PAPER TRAY

(71) Applicant: HEWLETT-PACKARD DEVELOPMENT COMPANY, L.P., Houston, TX (US)

(72) Inventors: Kevin Lo, Vancouver, WA (US); Brian Davis, Portland, OR (US)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 0 days.

(21) Appl. No.: 14/423,756

(22) PCT Filed: Sep. 26, 2012

(86) PCT No.: PCT/US2012/057208

§ 371 (c)(1),
(2) Date: Feb. 25, 2015

(87) PCT Pub. No.: WO2014/051556

PCT Pub. Date: Apr. 3, 2014

(65) Prior Publication Data

US 2015/0239265 A1 Aug. 27, 2015

(51) Int. Cl.
*B41J 11/00* (2006.01)
*B65H 1/26* (2006.01)
(Continued)

(52) U.S. Cl.
CPC *B41J 11/58* (2013.01); *B41J 29/02* (2013.01); *B65H 1/266* (2013.01);
(Continued)

(58) Field of Classification Search
CPC ..... B41J 11/58; B41J 29/02; B65H 1/266; B65H 2403/53; B65H 2405/1134; B65H 2511/152; B65H 2511/212; B65H 2511/30; B65H 2551/20; B65H 2601/122
USPC ..... 347/104
See application file for complete search history.

(56) References Cited

U.S. PATENT DOCUMENTS

| | | | | |
|---|---|---|---|---|
| 6,227,630 | B1 * | 5/2001 | Brown et al. | 312/223.2 |
| 6,322,264 | B1 | 11/2001 | Osmus et al. | |
| 7,258,435 | B2 * | 8/2007 | Silverbrook | 347/104 |
| 7,458,895 | B2 | 12/2008 | Tastad et al. | |
| 2006/0180994 | A1 * | 8/2006 | Jang | B65H 1/12 271/126 |
| 2012/0050982 | A1 | 3/2012 | Lin et al. | |

FOREIGN PATENT DOCUMENTS

| | | |
|---|---|---|
| JP | 62157344 | 7/1987 |
| JP | 0717644 | 1/1995 |

(Continued)

OTHER PUBLICATIONS

Ricoh, Ricoh Aficio SP3300DN Printer ABT Office Supplies Ltd. http://www.ricoh-photocopiers.co.uk/Printers/Ricoh_Aficio_SP3300DN_Printer.htm.

(Continued)

*Primary Examiner* — Lam S Nguyen
*Assistant Examiner* — Alexander D Shenderov
(74) *Attorney, Agent, or Firm* — Fabian Van Cott

(57) ABSTRACT

A printer paper tray comprising a paper tray bezel, and a paper tray cassette coupled to the paper tray bezel, in which the paper tray bezel moves in the x and y direction independent of the paper tray cassette. A printer comprising a paper tray comprising a bezel coupled to a cassette in which the bezel moves independent of the cassette and is biased towards the cassette in the x direction. A bezel mounting system comprising a number of biasing members to bias a printer tray bezel towards a printer tray cassette in the x-direction, and a number of biasing pads to bias the bezel in a substantially centered position with respect to the cassette.

15 Claims, 9 Drawing Sheets

(51) Int. Cl.

| | |
|---|---|
| ***B41J 11/58*** | (2006.01) |
| ***B65H 7/04*** | (2006.01) |
| ***B65H 1/14*** | (2006.01) |
| ***G03G 15/00*** | (2006.01) |
| ***B41J 29/02*** | (2006.01) |

(52) U.S. Cl.
CPC .... *B65H 2403/53* (2013.01); *B65H 2405/1134* (2013.01); *B65H 2511/152* (2013.01); *B65H 2511/212* (2013.01); *B65H 2511/30* (2013.01); *B65H 2551/20* (2013.01); *B65H 2601/122* (2013.01)

(56) References Cited

FOREIGN PATENT DOCUMENTS

| | | |
|---|---|---|
| JP | 10245139 | 9/1998 |
| JP | 2006103859 | 4/2006 |
| JP | 2006154557 | 6/2006 |

OTHER PUBLICATIONS

International Searching Authority, International Search Report, Date of Mailing Apr. 30, 2013.

* cited by examiner

PRINTER PAPER TRAY

BACKGROUND

Printers provide users with the ability to print a number of pages documents relatively easy. Printer trays provide the printer with a relatively larger amount of paper than would a single print job require. This allows multiple print jobs to be received and executed by the printer before the paper tray is to be resupplied with more paper. However, with the convenience of a relatively large supply of paper in the tray, the tray also provides gaps or holes through which a number of contaminants may pass. These gaps may be present in between the bezel portion of the paper tray assembly and the outer surface of the printer itself. With the gaps present, dust and other particles may be allowed to flow into the printer and cause damage to various parts of the printer such as the print heads and gears. Additionally, the gaps may allow printer noise to exit the printer causing the printer to sound noisy. Still further, aerosol particles from sources such as the ink used during printing operations may exit the printer via these gaps and cause the user's desk and the printer itself to be discolored.

BRIEF DESCRIPTION OF THE DRAWINGS

The accompanying drawings illustrate various examples of the principles described herein and are a part of the specification. The examples do not limit the scope of the claims.

Throughout the drawings, identical reference numbers designate similar, but not necessarily identical, elements.

DETAILED DESCRIPTION

Figure 1:
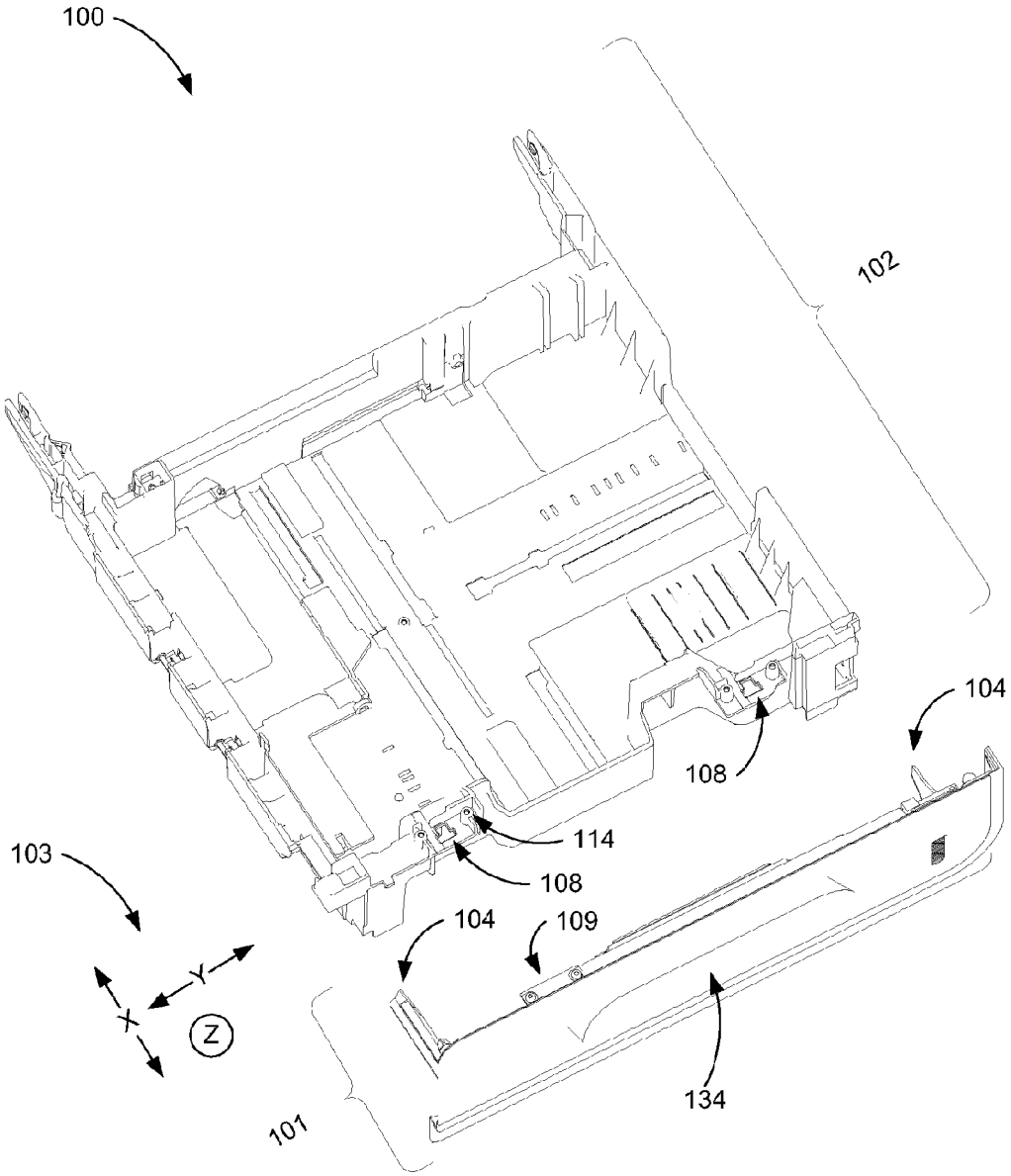
FIG. 1 is an isometric exploded of a paper tray according to one example of the principles described herein.

As described above, printers with paper trays as their source of paper may have gaps created between the paper tray and the housing. These gaps may allow exit or enter the printer causing damage to the mechanical parts therein. Some paper trays include a tray bezel that is attached to the tray itself and with which the tray is positioned in the tray slot by the bezel. With these types of paper trays, however, a large variation in the position of the paper in the printer is required.

This is because the bezel locates the paper tray into the printer which may cause variation in the position of the paper within the printer due to, for example, large tolerances in the parts used to make the paper tray. As the variation of the position of the paper increases, the printer must also adjust to accommodate for this larger range of paper positions. As such, the printer must have an apparatus for paper edge detection and must also have a wider print bar to deal with this variation.

Other paper trays include tray bezels that are attached to the tray and in which the tray is positioned and located in the tray slot by the tray itself. The tray may be aligned inside the printer slot, but because the bezel is rigidly coupled to the tray and because there are low part tolerances in plastic parts, this may result in misalignment with the other housing parts of the printer. Again, this misalignment of the tray bezel will result in the creation of gaps which results in the transfer of noise, contaminants, and particles out of and into the printer. Additionally, misalignment of the bezel with the printer's housing also produces aesthetically inferior product: potentially a product that looks broken or at least inferior in design or functionality.

The present specification, therefore describes a printer paper tray comprising a paper tray bezel, and a paper tray cassette coupled to the paper tray bezel, in which the paper tray bezel moves in the x and y direction independent of the paper tray cassette. The present specification further describes a printer comprising a paper tray comprising a bezel coupled to a cassette in which the bezel moves independent of the cassette and is biased towards the cassette in the x direction. Still further, the present specification describes a bezel mounting system comprising a number of biasing members to bias a printer tray bezel towards a printer tray cassette in the x-direction and z-direction, and a number of biasing pads to bias the bezel in a substantially centered position with respect to the cassette.

In the following description, for purposes of explanation, numerous specific details are set forth in order to provide a thorough understanding of the present systems and methods. It will be apparent, however, to one skilled in the art that the present apparatus, systems and methods may be practiced without these specific details. Reference in the specification to "an example" or similar language indicates that a particular feature, structure, or characteristic described in connection with that example is included as described, but may not be included in other examples.

Figure 2:
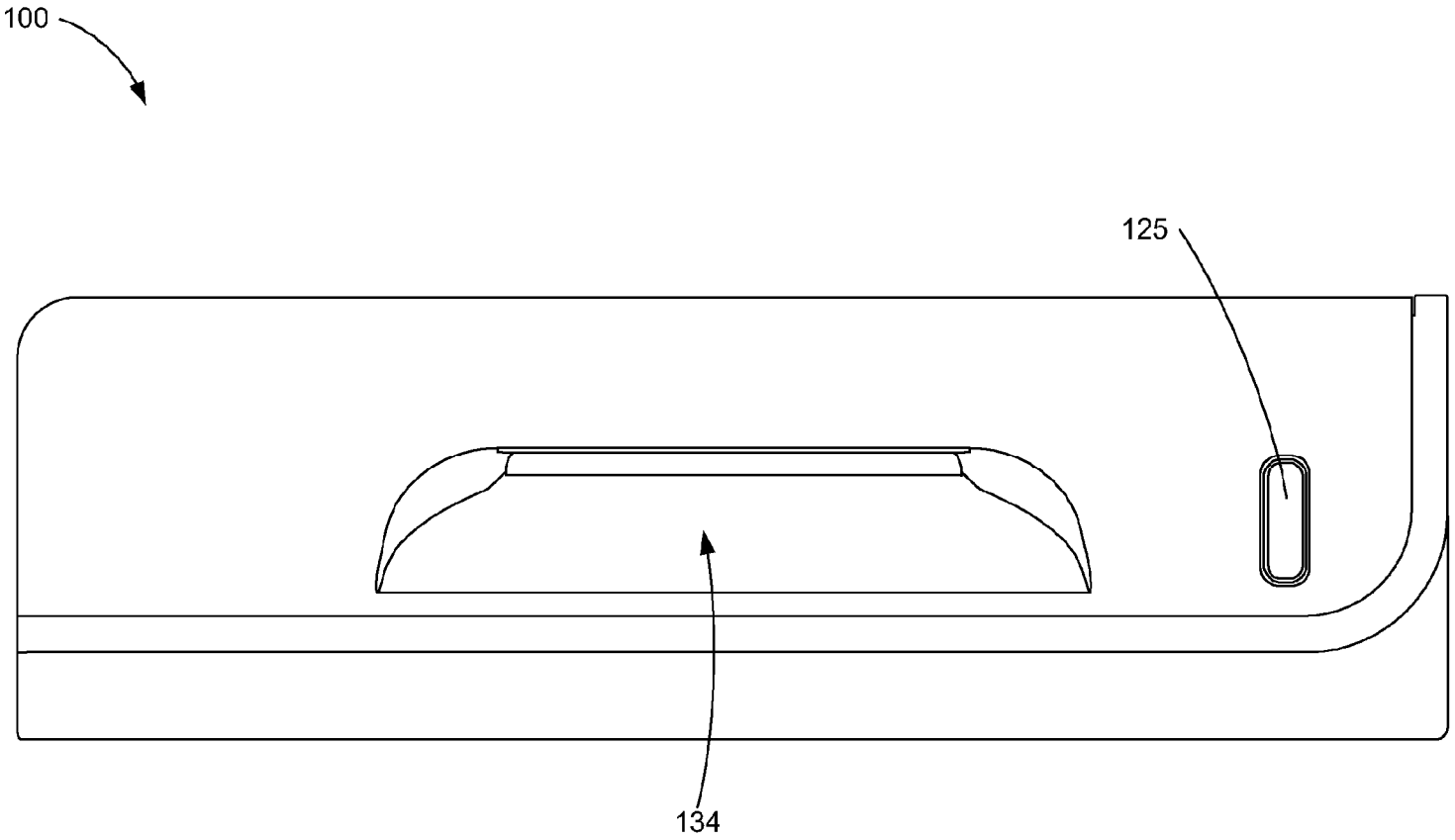
FIG. 2 is a front elevation view along the x-plane of the paper tray of FIG. 1 according to one example of principles described herein.

FIG. 1 is an isometric exploded view of a paper tray (100) is shown according to one example of the principles described herein. For ease of description, FIG. 1 includes planes of reference (103) describing the x, y, and z planes. The x-plane runs horizontally from the front of a bezel (101) to the back of a cassette (102). FIG. 2 shows the paper tray (100) as it would look if a person were viewing the front of the paper tray (100) along the x-plane. The y-plane runs from the one side of the paper tray (100) to the other and is perpendicular to the x-plane. Therefore, in FIG. 2, the y-plane of reference would run from right to left and from left to right of the drawing. The z-plane is perpendicular to both the x and y-plane and, looking at FIG. 2, would run from the top to the bottom and from the bottom to the top of the paper tray (100). The present specification will therefore use this reference frame to describe the various examples of the paper tray (100).

Reference will now be made to FIGS. 1, 2, and 3. FIG. 1 shows a paper tray (100) comprising a paper tray bezel (101) and a paper tray cassette (102). The bezel (101) may be coupled to the cassette (102) in such a way so as to allow the bezel (101) to "float" with respect to the cassette (102). The present specification describes how the bezel (101) is attached to cassette (102) such that the bezel (101) is biased toward the cassette (102) when the paper tray (100) is out of a printer, but is pushed away from the cassette (102) when inserted into the printer. The paper tray (100) may be any shape and size such that it may fit into a paper tray slot of a printer. Therefore, although the figures in the present specification appear to show a paper tray (100) have certain dimensions; the principles described herein would be applicable to any size or shape of paper tray (100) for any given type of printer. The present specification, therefore, contemplates this.

Figure 3A:
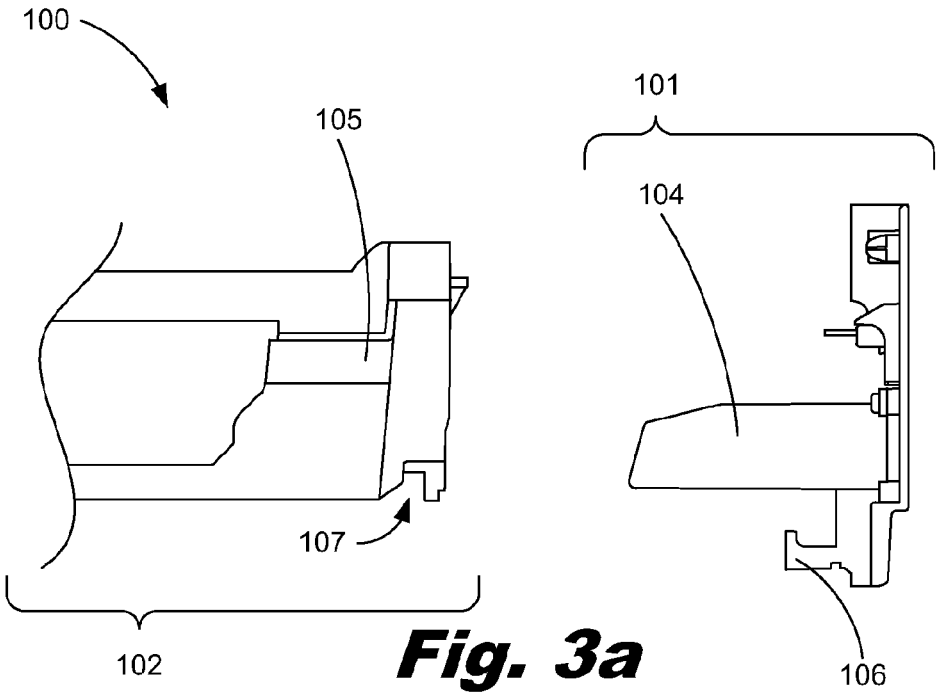
FIGS. 3*a* and 3*b* are left and right exploded elevational views respectively of the paper tray according to one example of principles described herein.
Figure 3B:
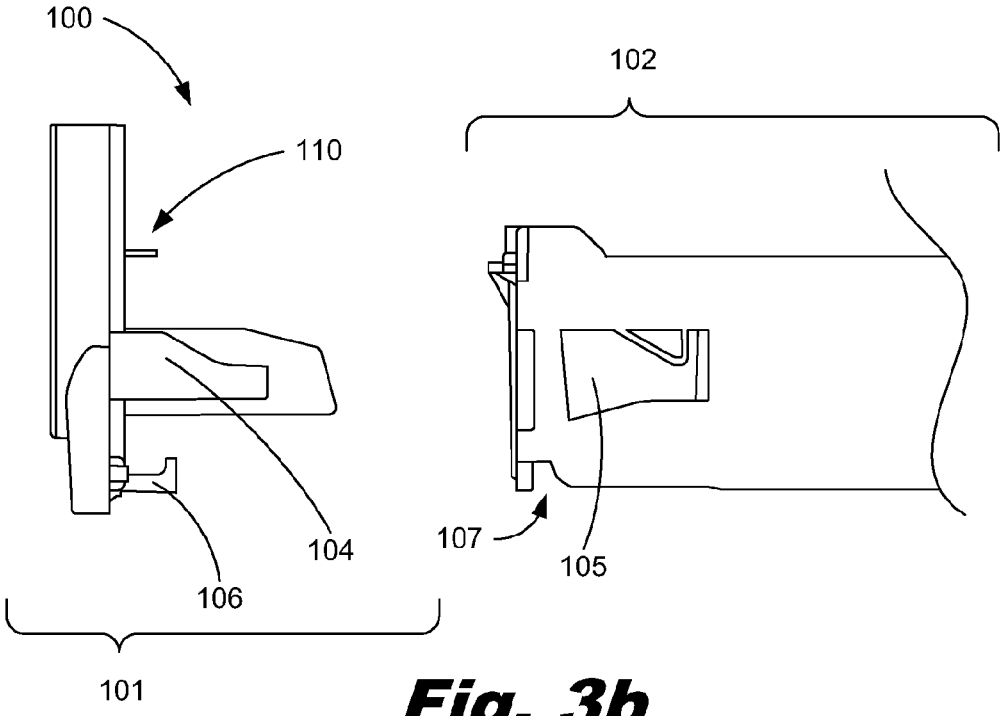

FIG. 1 shows the bezel (101) and cassette (102) separated or in an exploded view for ease of description. The bezel (101) comprises a number of posts (104) extending away from the bezel (101) in the x-direction. These posts (104) may be more easily seen in FIGS. 3*a* and 3*b*. FIGS. 3*a* and 3*b* are left and right exploded elevational views respectively of the paper tray (100) according to one example of principles described herein. The posts (104) are fit into slots (105) located within the cassette (102). Each of the posts (104) and slots (105) are sized such that the bezel (101) is partially allowed to move along the x and y-planes respective to the cassette (102) but is restricted from moving in the z-plane. Additionally, the posts (104) and slots (105) are sized such that the bezel (101) will not rotate in the theta-x direction. Specifically looking a FIG. 2 as a reference, with the tolerances of the posts (104) and slots (105), the bezel (101) is restricted from rotating clockwise or counterclockwise respective to the cassette (102).

Therefore, the paper tray (100) provides for partial movement of the bezel (101) with respect to the cassette (102) in the x and y-planes and partial restricts movement of the bezel (101) with respect to the cassette (102) as described above. The freedom and restrictions of movement of the bezel (101) with respect to the cassette (102) provides for a paper tray (101) having appropriate functionality as will be described below as well as higher consumer acceptability. Specifically the freedom of movement in the x- and y-planes allows for the bezel (101) to float while inserted into a printer thereby creating both a seamless interface between the paper tray (100) and an aesthetically pleasing look to a user. The restrictions in movement mentioned above also provide stability in handling the paper tray (100) while it is out of the printer. A user may feel that when the bezel (101) is allowed to move in the z and theta-x planes it may indicate that the paper tray (100) is an inferior product because it "floats" too much.

Looking again at FIGS. 3*a* and 3*b*, the bezel may further include a number of hooks (106). The cassette (102) may also include a number of hook recesses (107) defined in the body of the cassette (102). During installation of the bezel (101) to the cassette (102), the hooks (106) may be inserted into the hook recesses (107). The interfacing of the hooks (106) and hook recesses (107) can be seen in FIGS. 4*a* and 4*b*. Although the hooks (106) and hook recesses (107) shown in FIGS. 3*a*, 3*b*, 4*a*, and 4*b* are shown to be at the bottom, a number of configurations and placements of these elements on the bezel (101) and cassette (102) are contemplated by the present specification. In the examples shown in the figures, however, the hooks (106) may be coupled with the recesses (107) while the posts (104) of the bezel (101) are engaged with the slots (105) of the cassette (102). This may provide for further stability when the bezel (101) is coupled to the cassette (102) and also substantially prevents the bezel from moving in the z-plane with respect to the cassette.

Although the posts (104), hooks (106), and hook recesses (107) substantially prevent the bezel (101) from moving in the z-direction, movement along the z-plane may not be entirely limited and a minimal amount of movement may be allowed along the z-plane. In one example, the movement of the bezel (101) along the x-plane with respect to the cassette (102) may be around 4 mm. In another example, the movement of the bezel (101) along the x-plane with respect to the cassette (102) may be around 2 mm in either the negative or positive directions from center. In still another example, the movement of the bezel (101) along the y-plane with respect to the cassette (102) may be around 4 mm in either the negative or positive directions from center. In yet another example, the movement of the bezel (101) along the y-plane with respect to the cassette (102) may be around 2 mm in either the negative or positive directions from center.

Figure 5A:
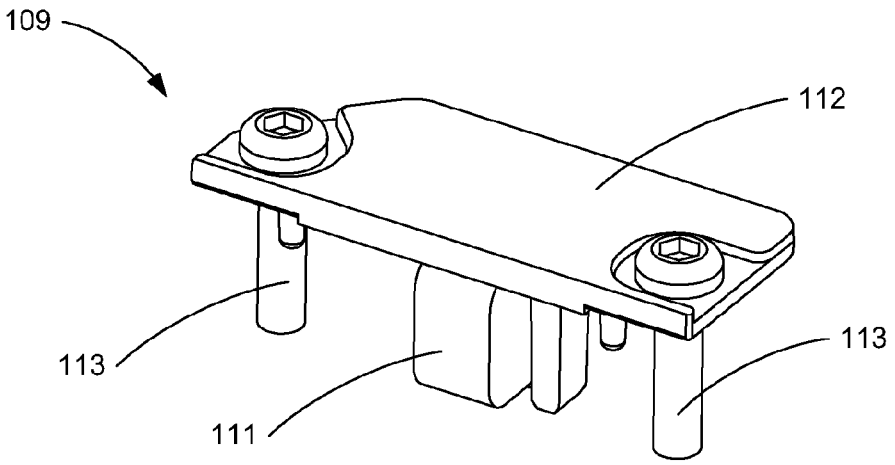
FIGS. 5*a* through 5*c* are a top isometric view, a front elevational view, and a bottom isometric view, respectively, of a t-shaped resistive element according to one example of principles described herein.
Figure 5B:
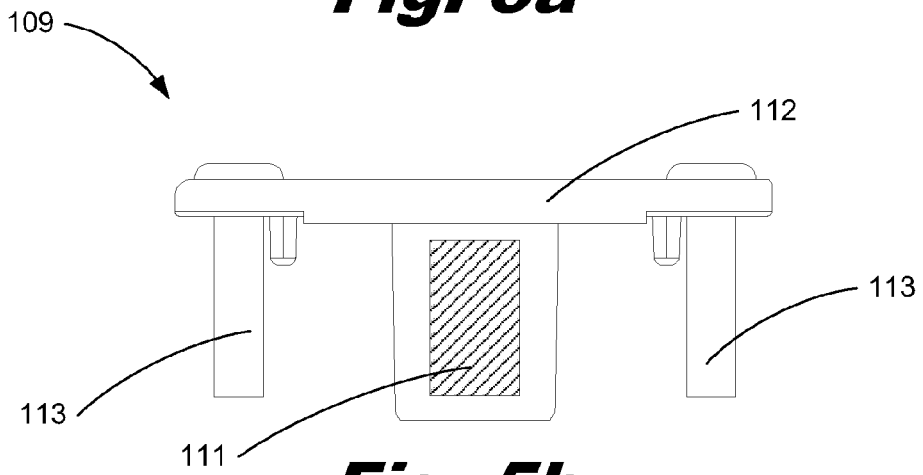
Figure 5C:
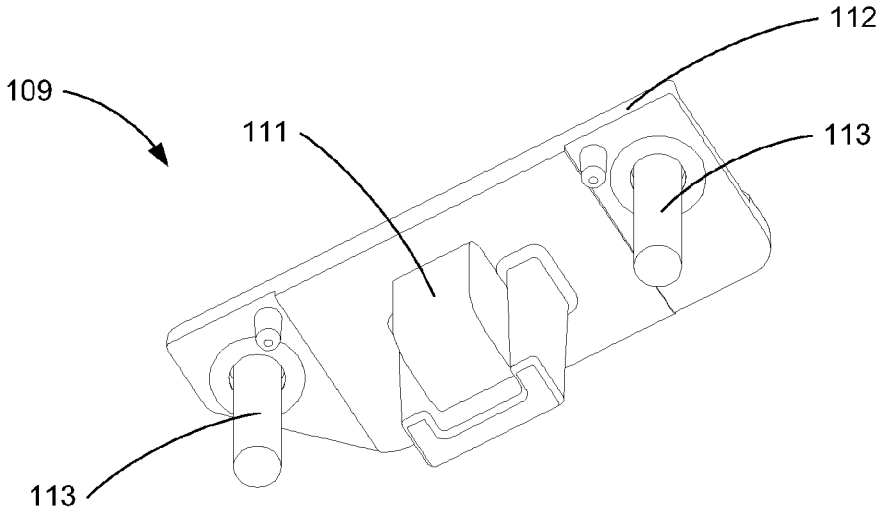

As described above, the bezel (101) is coupled to the cassette (102) at, for example, the bottom of the bezel (101) using the hooks (106) and hook recesses (107). The bezel (101) may be coupled to the cassette (102) with the help of a number of biasing members (109). FIGS. 5*a*-5*c* shows an example of one of the biasing member (109). The biasing members (109) may comprise a t-shaped resistive member (111), a mounting plane (112), and a number of cassette mounting screws (113). In one example, the number of biasing members (109) used to bias the bezel (101) to the cassette (102) is four; two biasing members (109) mounting the bezel (101) to the cassette (102) generally at the top of the bezel (101) and two biasing members (109) mounting the bezel (101) to the cassette (102) generally at the bottom of the bezel (101). The number and position of the biasing members (109) may vary, however, and the examples shown in the figures are meant to be examples only.

Figure 4A:
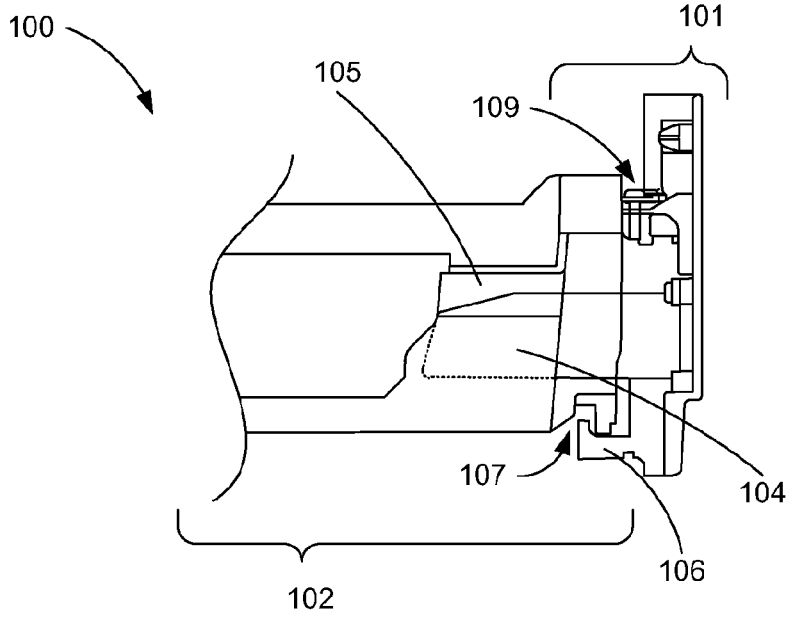
FIGS. 4*a* and 4*b* are left and right elevational respectively of the paper tray of FIGS. 3*a* and 3*b* respectively according to one example of principles described herein.
Figure 4B:
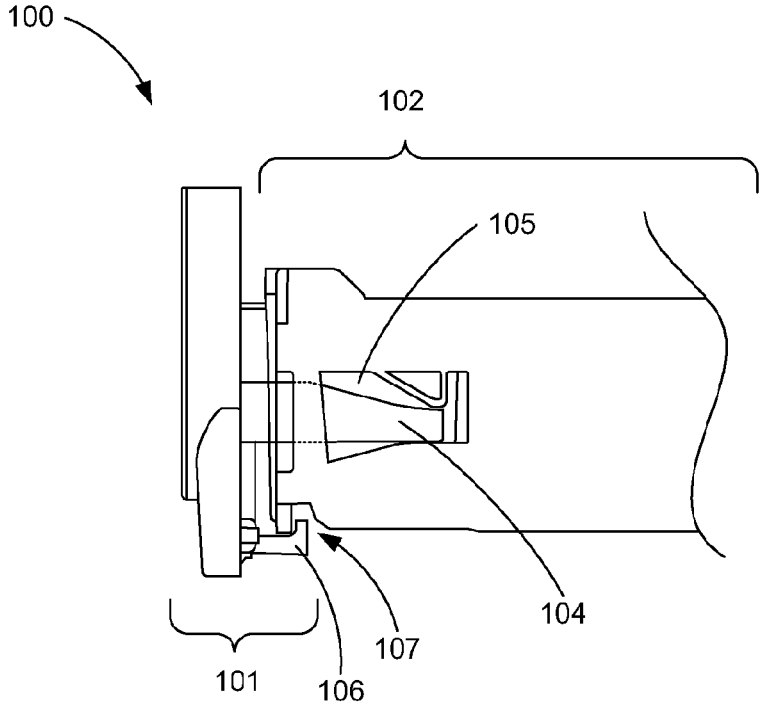

These biasing members (109) can also be seen in FIGS. 1 and 4*a*. Looking at FIG. 3*b*, the t-shaped resistive member (111) of a biasing member (109) may be inserted through an abutment bracket (110) coupled to the bezel (101); the abutment bracket (110) defining a void therein through which the t-shaped resistive member (111) of the biasing member (109) is inserted. FIG. 1 shows the biasing member (109) being inserted through the abutment bracket (110). Once inserted through the abutment bracket (110), the t-shaped resistive member (111) may be inserted into a t-shaped void (108) defined in the cassette (102). The biasing member (109) may then be secured to the cassette (102) using the cassette mounting screws (113); the cassette (102) further defining screw holes (114) into which the cassette mounting screws (113) may be screwed.

Once assembled into the cassette (102), the biasing member (109) causes the bezel (101) to be biased towards the cassette (102). This is because the t-shaped resistive element (111) abuts the inner surface of the void of the abutment bracket (110) that is closest to the cassette (102). This causes the entire bezel (101) to be pushed towards the cassette (102).

The t-shaped resistive element (111) may be made of a number of resistive materials. In one example, the t-shaped resistive element (111) may be made of foam. In another example, the t-shaped resistive element (111) may be made of rubber. Other materials may be used which are resilient and the present specification contemplates the use of those materials. In another example, a spring may be used as a biasing member; the spring coupling the bezel (101) directly to the cassette (102).

Figure 6:
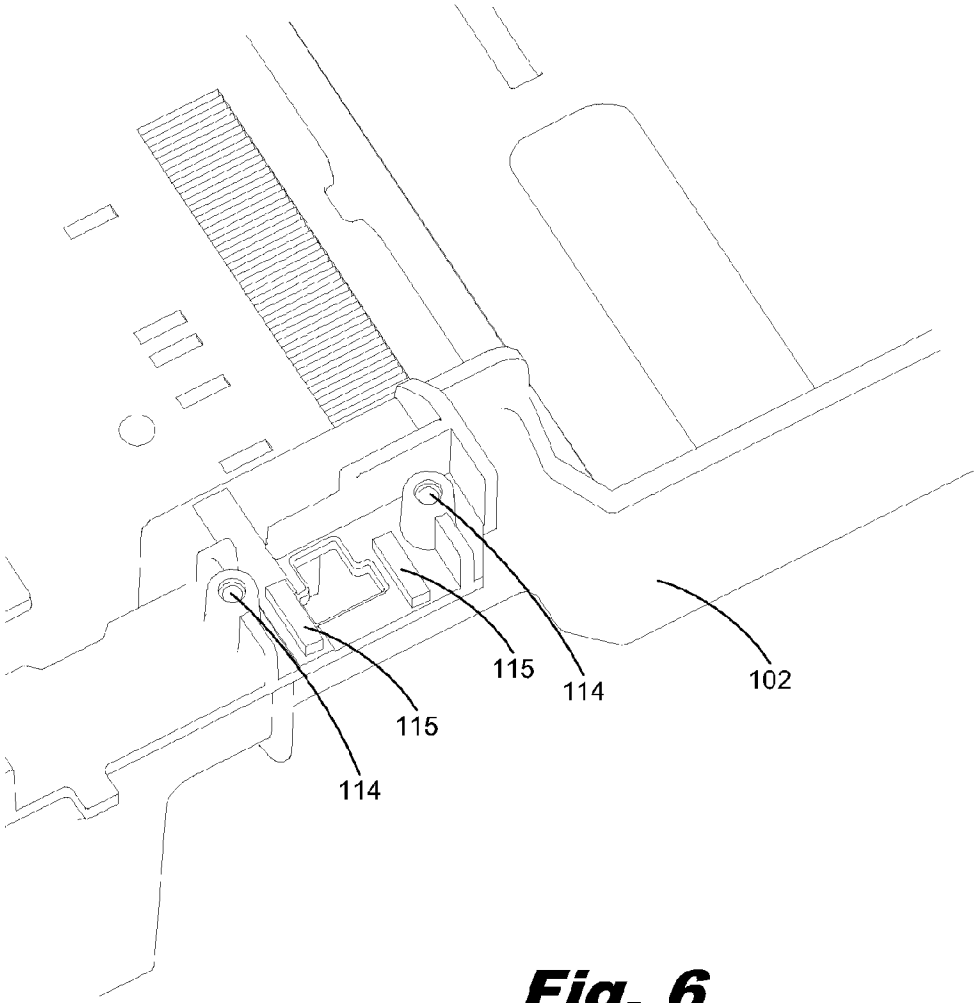
FIG. 6 is a selected isometric view of the cassette shown in FIG. 1 with a number of biasing pads according to one example to the principles described herein.

Also, as described above, the paper tray (100) may further comprise a number of biasing pads (115) to bias the bezel (101) in the y-plane respective of the cassette (102). Specifically, the biasing pads (115) may bias the bezel (101) in a centered position with respect to the cassette (102) such that movement of the bezel (101) in either the negative or positive y-direction results in the return of the bezel (101) in a centered position once the force has been released. FIG. 6 shows a selected isometric view of the cassette (102) shown in FIG. 1 with a number of biasing pads (115) according to one example to the principles described herein. In this example, the biasing pads (115) are situated next to the t-shaped void (108) defined in the cassette (102). The biasing pads (115) are situated such that the surfaces of the biasing pads (115) facing the t-shaped void (108) come in contact with the outer surface of the abutment bracket (110). As a result, when the bezel (101) is moved in either the positive or negative y-direction, the abutment bracket (110) pushes against the biasing pads (115). As the force is released, the biasing pads (115) cause the bezel (101) to re-center itself with respect to the cassette (102). Although FIG. 6 shows the biasing pads being situated next to the t-shaped void (108), the position and number of biasing pads (115) may be varied. Other examples may include biasing pads that are abutting other portions of the bezel (101) such that they bias the bezel (101) in a similar manner as described above.

Figure 7:
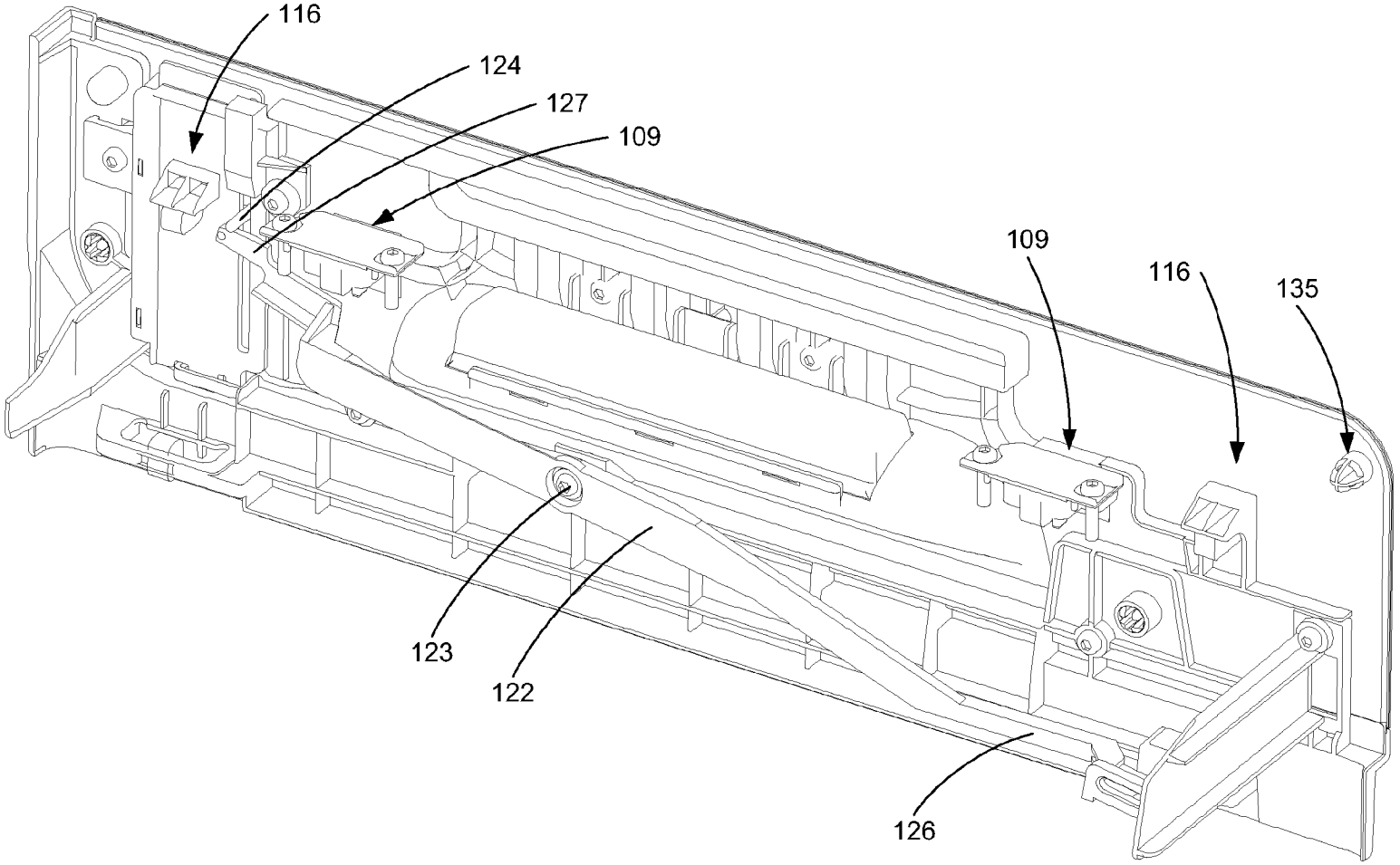
FIG. 7 is an isometric view of the backside of the bezel according to one example of the principles described herein.

The bezel (101) may further include a number of z-direction biasing pads (116) which bias any movement of the bezel (101) in the positive z-direction. FIG. 7 is an isometric view of the backside of the bezel showing an example of the z-direction biasing pads (116) according to one example of the principles described herein. The z-direction biasing pads (116) allow for the minimal amount of z-direction movement in the bezel (101) to be counteracted such that the bezel (101) may be realigned in the z-direction after a force in the z-direction against the bezel (101) has been removed.

Still further, the bezel (101) may have a number of bezel spikes (135) coupled to it. The bezel spikes (135) may further help to substantially prevent the y- and z-direction movement of the bezel (101) with respect to the printer housing. This is done by defining a number of bezel spike holes in the printer housing into which the bezel spikes (135) to be inserted. The bezel spike holes may be formed such as to still allow the x and y-directional movement of the bezel (101).

Figure 8:
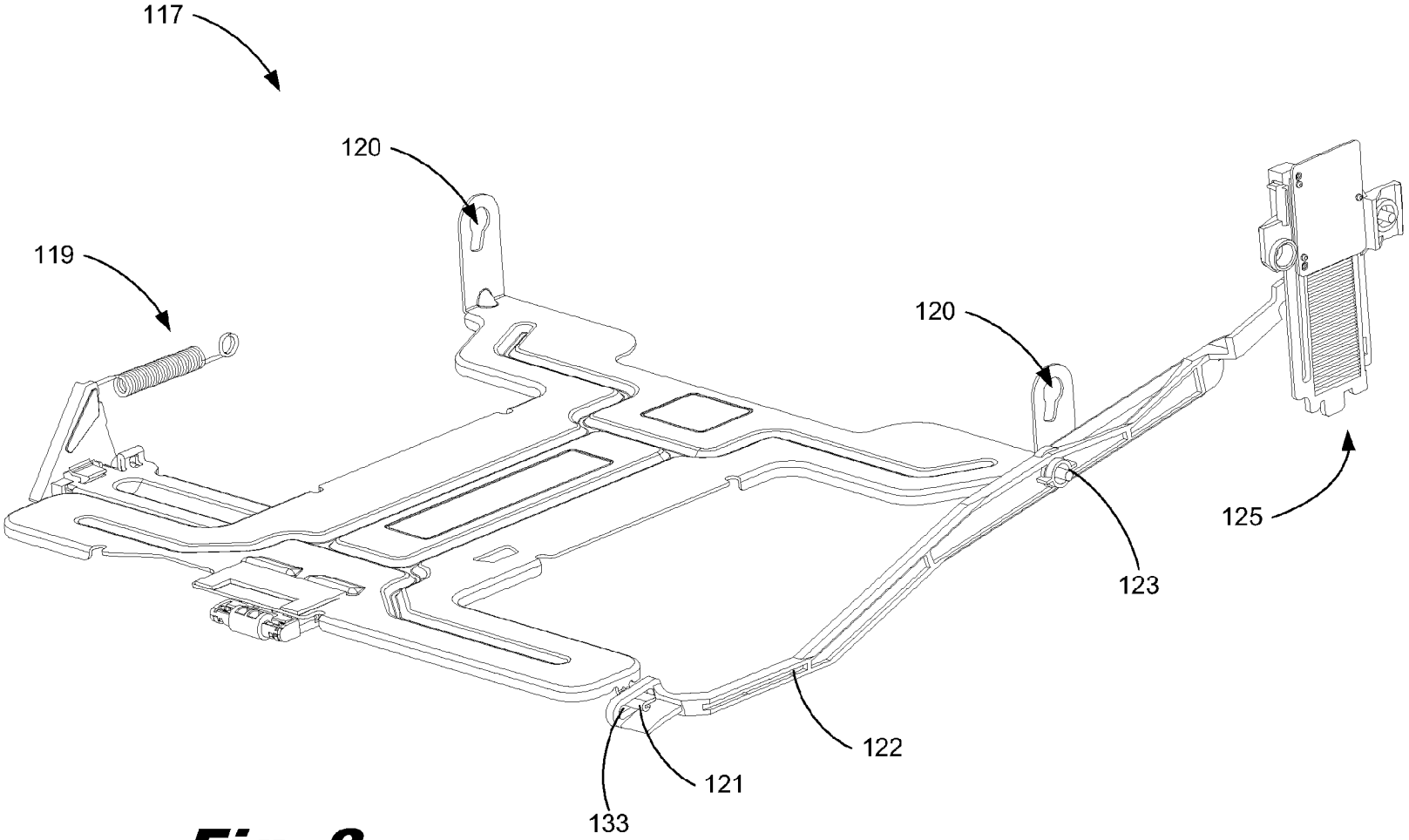
FIG. 8 is an isometric view of a sub-tray and paper level indicating system according to one example of the principles described herein.

The paper tray (100) may further include a sub-tray (117) and paper level indicating system (118). FIGS. 7 and 8 together show an isometric view of a sub-tray (117) and paper level indicating system (118) according to one example of the principles described herein. Reference will now be made to these drawings. The sub-tray (117) shown in FIG. 8 is fits inside the cassette (102). Additionally, when the cassette (102) is supplied with paper, the paper may sit on top of the sub-tray (117). The sub-tray (117) may include a spring (119) with a first end of the spring coupled to the sub-tray (117) and the second end of the spring coupled to the cassette (102). The spring provides and upward bias on the sub-tray (117) such that when no paper is in the cassette (102) the sub-tray (117) is pulled upward by the spring (119). A portion of the sub-tray (117) may also be attached to the cassette (102) such that one side of the sub-tray (117) serves as a pivot upon which the sub-tray (117) may rotate. Pivot holes (120) may therefore be defined in the sub-tray (117) to provide this pivot point. As paper is loaded into the cassette (102), the weight of the paper may overcome the biasing force of the spring (119) such that the sub-tray (117) sits flush against the inner bottom of the cassette (102). In one example, the upward biasing force by the spring (119) and sub-tray (117) allows for the paper placed inside the tray to be received by a paper engine located in the printer.

The sub-tray (117) also comprises a finger portion (121) which extends away from the rest of the body of the sub-tray (117) and engages with a paper level indicating system (118). Looking at FIG. 7, the paper level indicating system (118) may comprise a rocker arm (122), a pivot point (123), an indicator rod (124), and an indicator window (FIG. 2, 125). Each of these features will now be described in more details as to their function.

As mentioned, as the supply of paper decreases in the cassette (102), the sub-tray (117) begins to rise due to the biasing force supplied on it by the spring (119). When this happens, the finger portion (121) also pushes upward on a first end of the rocker arm (122). Because the rocker are is pivotally coupled to the bezel (101) via a pivot point (123), upward motion of a first end (126) of the rocker arm (122) results in downward motion of the opposite or second end (127) of the rocker arm (122). This downward motion of the second end (127) of the rocker arm (122) adjusts an indicator rod (124) located within the indicator window (FIG. 2, 125). The indicator rod (124) passes from the front through to the back of the bezel (101). The adjustment by the rocker arm (122) of the finger rod (124) therefore indicates the amount of paper remaining within the paper tray (100).

The first end (121) of the rocker arm comprises a rocker arm hole (133) defined therein through which the finger portion (121) may engage with the rocker arm (122) as described above. Because the bezel (101) moves independent of the cassette (102) in the x, y, and z-directions, the rocker arm hole (133) is large enough to adjust for the changes in the relative position of the bezel (101) to the cassette (102). This allows for an accurate paper level reading in the indicator window (FIG. 2, 125) regardless of the actual position of the bezel (101) with respect to the cassette (102).

Figure 9:
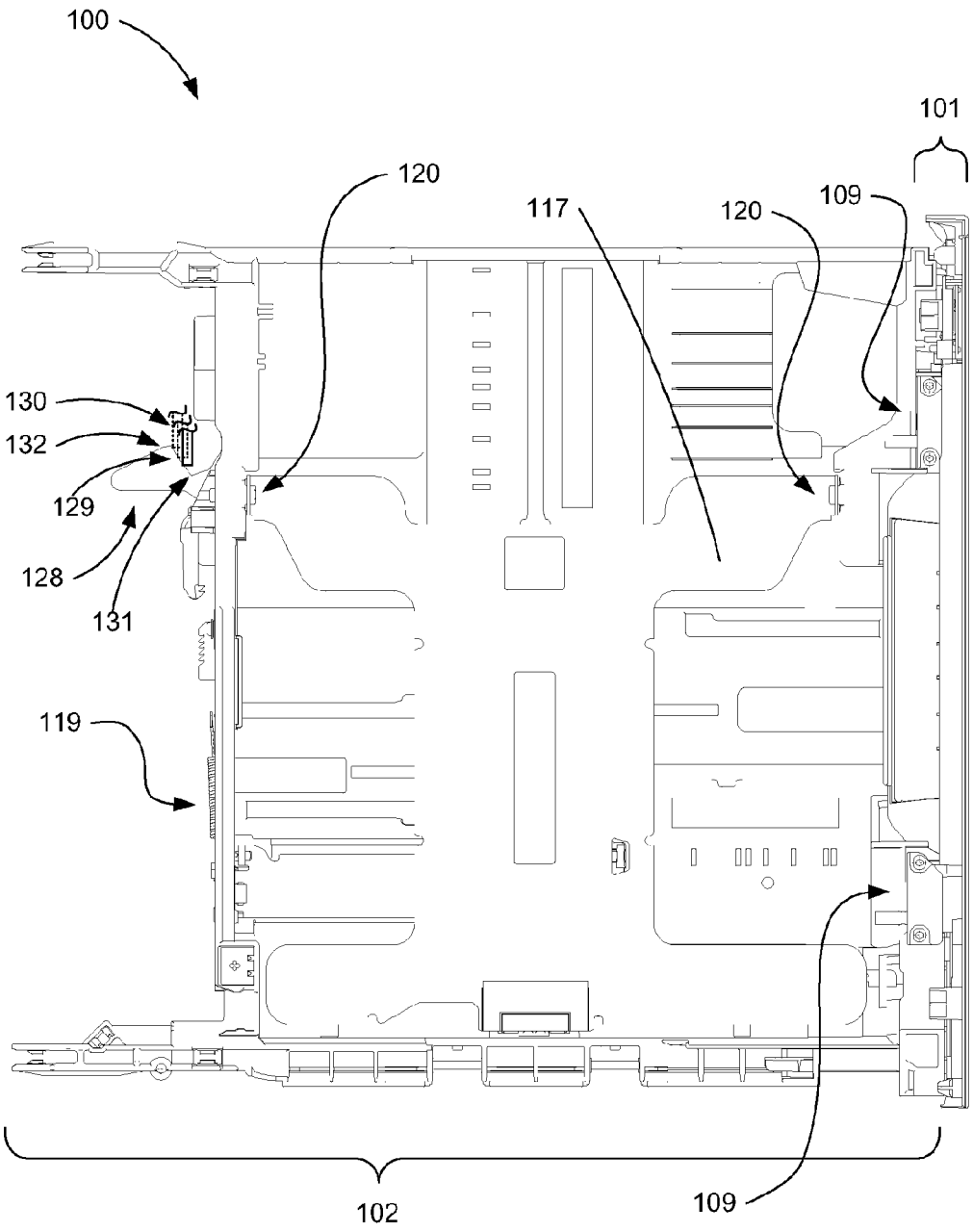
FIG. 9 is a top elevation view of the paper tray of FIG. 1 according to one example of the principles described herein.

The paper tray (100) may further include a tray hook (128). Turning how to FIG. 9, a top elevation view of the paper tray (100) of FIG. 1 according to one example of the principles described herein. The tray hook (128) servers to help seat the paper tray (100) in the printer. Specifically, the tray hook (128) helps to overcome the bias force mused by the biasing members (109). The tray hook (128) comprises a slop portion which is mean to help the hook engage with a retention rib (130) inside the paper tray (100) slot of the printer. The retention rib (130) is shown in FIG. 9 in both ghost and solid view showing the movement of the retention rib (130) as it slides down the slop and rests in a valley (131) defined in the tray hook (128). As described, the retention rib (130) may be allowed to move such that the hook (128) overcomes a spring force and slips into the valley (131) of the hook (128). In another example, the hook (128) may be allowed to move such that when the paper tray (100) is inserted into the printer, the front of the hook (128) comes in contact with a rigidly set retention rib (130) and the force of the paper tray (100) being inserted overcomes a spring form which causes the hook (128) to move down with respect to the view shown in FIG. 9. Once a hill (132) of the hook (128) passes by the rod (130), the resistive force of the hook (128) causes the hook (128) to slip behind the retention rib (130) and set the paper tray (100) in place.

In either example, the resistive forces are sufficient to overcome the resistive forces presented by the biasing members (109). As a result, the bezel (101) is pulled away from the cassette (102) once the housing of the bezel (101) comes in contact with the housing of the printer. Therefore, the insertion of the paper tray (100) advantageously allows the per tray (100) to be properly set in the slot of the printer while the bezel (100) is properly aligned with other housing members of the printer.

As a result of the above, the printer paper tray may have a number of advantages, including: better fit of the paper tray (100) within the printer, better fit of the bezel (101) on the outside of the printer, as well as easier user handling of the paper tray. The present paper tray also adds to a consistent atheistic look to the printer as the bezel is capable of fitting better with the housing of the printer. Additionally, because the bezel (101) is tightly fit against the housing of the printer, gaps have not formed between the paper tray (100) and the housing of the printer. This reduces the amount of contaminants entering and exiting the printer. Additionally, the gaps prevent printer noises from escaping the printer. Still further, the present printer paper tray (100) provides for a printer that does not require an apparatus for paper edge detection or a wider print bar to deal with any variation in the paper position while the tray is in the printer. Even further, the printer paper tray allows for a user to use a single handle (FIG. 2, 134) to remove and insert the paper tray into the printer as opposed to having to use two hands and pulling the tray out of the printer via opposing sides of the paper tray.

The preceding description has been presented to illustrate and describe examples of the principles described. This description is not intended to be exhaustive or to limit these principles to any precise form disclosed. Many modifications and variations are possible in light of the above teaching.

What is claimed is:

1. A printer paper tray comprising:

a paper tray bezel to position the printer paper tray within a printer;

a paper tray cassette coupled to the paper tray bezel; and a hook coupled to a back of the paper tray cassette to, once inserted into the printer, engage with a retention rib in the printer;

in which the paper tray bezel moves relative to, and independent from, the paper tray cassette in an x-direction and in a y-direction, and in which engagement of the hook with the retention rib causes the paper tray cassette to be resistively pulled away from the paper tray bezel and the paper tray bezel to sit flush against a housing of the printer.

2. The printer paper tray of claim 1, further comprising a number of resistive elements coupling the paper tray bezel to the paper tray cassette in which the resistive elements bias the paper tray bezel toward the paper tray cassette in the x-direction.

3. The printer paper tray of claim 1, further comprising a number of resistive elements coupled to the printer paper tray in which the resistive elements bias the paper tray bezel with respect to the paper tray cassette in a substantially centered y-direction.

4. The printer paper tray of claim 1, further comprising a cassette sub-tray laid into the paper tray cassette and onto which an amount of paper is placed, a weight of the paper causing a resistive force to be overcome such that the cassette sub-tray is set flush with the bottom interior of the paper tray cassette;

a rocker arm mechanically coupled to the cassette sub-tray and pivotally coupled to the paper tray bezel, in which upward vertical movement of the cassette sub-tray causes a first end of the rocker arm to move vertically up while causing, a second end of the rocker arm to move vertically down; and a paper supply indicating window defined in the paper tray bezel through which a vertical position of the second end of the rocker arm indicates the amount of paper present in the paper tray.

5. The printer paper tray of claim 4, in which the first end of the rocker arm further defines a hole into which a portion of the cassette sub-tray is inserted and in which a size of the hole is large enough to adjust for changes in a relative position of the paper tray bezel to the paper tray cassette.

6. The printer paper tray of claim 1, further comprising:

a number of second hooks coupled to the paper tray bezel; and a number of second hook recesses defined in the paper tray cassette;

in which the second hooks engage with the second hook recesses to couple the paper tray bezel to the paper tray cassette.

7. The printer paper tray of claim 1, further comprising:

a number of posts coupled to the paper tray bezel; and a number of slots defined in the paper tray cassette;

in which the posts engage with the slots to couple the paper tray bezel to the paper tray cassette and substantially prevent the paper tray bezel from moving in a z-plane with respect to the paper tray cassette.

8. The printer paper tray of claim 1, wherein the paper tray bezel moves less than four millimeters relative to the paper tray cassette in the x-direction.

9. The printer paper tray of claim 1, wherein the paper tray bezel moves less than four millimeters relative to the paper tray cassette in the y-direction.

10. The printer paper tray of claim 1, further comprising a number of bezel spikes coupled to the paper tray bezel.

11. The printer paper tray of claim 1, further comprising a tray hook to seat the paper tray in the printer.

12. A printer comprising:

a paper tray comprising a bezel coupled to a cassette;

in which the bezel moves independent of, and relative to, the cassette and is biased towards the cassette in an x-direction; and a hook coupled to the back of the cassette to, once inserted into the printer, engage with a retention rib in the printer;

in which engagement of the hook with the retention rib causes the cassette to be resistively pulled away from the bezel and the bezel to sit flush against a printer housing.

13. The printer of claim 12, in which the paper tray further comprises a number of resistive elements coupling the bezel to the cassette in which the resistive elements bias the bezel to the cassette in the x-direction.

14. The printer of claim 12, in which the paper tray further comprises:

a cassette sub-tray laid into the cassette and onto which an amount of paper is placed, a weight of the paper causing a resistive force to be overcome such that the cassette sub-tray is set flush with a bottom interior of the cassette;

a rocker arm mechanically coupled to the cassette sub-tray and pivotally coupled to the bezel, in which upward vertical movement of the cassette sub-tray causes a first end of the rocker arm to move vertically up while causing a second end of the rocker arm to move vertically down; and a paper supply indicator window defined, in the bezel through which a vertical position of the second end of the rocker arm causes a finger rod to indicate the amount of paper present in the paper tray.

15. The primer of claim 12, in which the paper tray further comprises a number of resistive elements coupled to the paper tray in which the resistive elements bias the bezel with respect to the cassette in a substantially centered y-direction.

* * * * *